US011527203B2

(12) United States Patent
Dong

(10) Patent No.: US 11,527,203 B2
(45) Date of Patent: Dec. 13, 2022

(54) PIXEL CIRCUIT, DRIVING METHOD AND DISPLAY DEVICE

(71) Applicant: BOE Technology Group Co., Ltd., Beijing (CN)

(72) Inventor: Tian Dong, Beijing (CN)

(73) Assignee: BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 0 days.

(21) Appl. No.: 17/417,318

(22) PCT Filed: Sep. 18, 2020

(86) PCT No.: PCT/CN2020/116141
§ 371 (c)(1),
(2) Date: Jun. 22, 2021

(87) PCT Pub. No.: WO2021/057611
PCT Pub. Date: Apr. 1, 2021

(65) Prior Publication Data

US 2022/0076631 A1 Mar. 10, 2022

(30) Foreign Application Priority Data

Sep. 24, 2019 (CN) ..... 201910905348.8

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0819* (2013.01);
(Continued)

(58) Field of Classification Search
CPC ..... G09G 3/3258; G09G 3/3233; G09G 2300/0819; G09G 2310/061; G09G 2310/08; G09G 2320/0233
(Continued)

(56) References Cited

U.S. PATENT DOCUMENTS 9,824,633 B2 * 11/2017 Qing ..... G09G 3/3241
10,916,197 B1 * 2/2021 Zhang ..... G09G 3/3258
(Continued)

FOREIGN PATENT DOCUMENTS

CN 1734532 A 2/2006
CN 102074189 A 5/2011
(Continued)

OTHER PUBLICATIONS

International Search Report and Written Opinion received for PCT Patent Application No. PCT/CN2020/116141, dated Dec. 17, 2020, 13 pages.
(Continued)

*Primary Examiner* — Tom V Sheng
(74) *Attorney, Agent, or Firm* — Workman Nydegger

(57) ABSTRACT

A pixel circuit, a driving method, and a display device are provided. The pixel circuit includes: a signal input subcircuit, a threshold compensation subcircuit, a light-emitting control subcircuit, a drive transistor, a light-emitting device. The signal input subcircuit writes a voltage at a data signal end, a voltage at a reference voltage signal end, and a threshold voltage of the drive transistor into a gate thereof according to signals of first, second, and third control signal ends. The threshold compensation subcircuit turns on a gate of the drive transistor and a drain thereof under the control of a signal of a reset signal end. The light-emitting control subcircuit turns on a first power supply end and the drive transistor, and turns on the drive transistor and the light-
(Continued)

emitting device under the control of a signal of a first light-emitting control end and a signal of a second light-emitting control end.

19 Claims, 13 Drawing Sheets

(52) U.S. Cl.
CPC ... *G09G 2310/061* (2013.01); *G09G 2310/08* (2013.01); *G09G 2320/0233* (2013.01)

(58) Field of Classification Search
USPC ..... 345/691
See application file for complete search history.

(56) References Cited

U.S. PATENT DOCUMENTS

| | | | | |
|---|---|---|---|---|
| 11,074,864 | B1 * | 7/2021 | Lu | G09G 3/325 |
| 11,270,646 | B2 * | 3/2022 | Zhang | G09G 3/3258 |
| 2011/0115772 | A1 | 5/2011 | Chung | |
| 2012/0147060 | A1 * | 6/2012 | Jeong | G09G 3/3233 345/82 |
| 2014/0192037 | A1 * | 7/2014 | Chung | G09G 3/2022 345/82 |
| 2016/0042694 | A1 * | 2/2016 | Lim | G09G 3/3233 345/78 |
| 2016/0148569 | A1 * | 5/2016 | Park | G09G 3/3233 345/212 |
| 2016/0180775 | A1 | 6/2016 | Kim | |
| 2016/0351123 | A1 * | 12/2016 | Qing | G09G 3/3241 |
| 2017/0140707 | A1 * | 5/2017 | Xu | G09G 3/3258 |
| 2017/0221420 | A1 | 8/2017 | Zhu | |
| 2017/0301290 | A1 * | 10/2017 | Qing | G09G 3/3233 |
| 2018/0197476 | A1 * | 7/2018 | Xi | G09G 3/3233 |
| 2018/0315374 | A1 * | 11/2018 | Zhang | G09G 3/3266 |
| 2019/0073946 | A1 * | 3/2019 | Su | H01L 27/3262 |
| 2019/0103055 | A1 * | 4/2019 | Gao | G09G 3/3233 |
| 2019/0304361 | A1 * | 10/2019 | Lu | H01L 27/3262 |
| 2020/0090591 | A1 * | 3/2020 | Wang | G09G 3/3258 |
| 2020/0168692 | A1 * | 5/2020 | Liu | H01L 27/3276 |
| 2021/0074214 | A1 * | 3/2021 | Li | G09G 3/3266 |
| 2021/0118371 | A1 * | 4/2021 | Qing | G09G 3/3233 |
| 2021/0158754 | A1 * | 5/2021 | Umezawa | G09G 3/3233 |
| 2022/0051627 | A1 * | 2/2022 | Yang | G09G 3/3258 |

FOREIGN PATENT DOCUMENTS

| | | | |
|---|---|---|---|
| CN | 102254510 | A | 11/2011 |
| CN | 103280182 | A | 9/2013 |
| CN | 104078005 | A | 10/2014 |
| CN | 203895464 | U | 10/2014 |
| CN | 104282266 | A | 1/2015 |
| CN | 104318897 | A | 1/2015 |
| CN | 104575392 | A | 4/2015 |
| CN | 104700780 | A | 6/2015 |
| CN | 105185305 | A | 12/2015 |
| CN | 105489168 | A | 4/2016 |
| CN | 106652904 | A | 5/2017 |
| CN | 106652912 | A | 5/2017 |
| CN | 106782322 | A | 5/2017 |
| CN | 106910462 | A | 6/2017 |
| CN | 107154239 | A | 9/2017 |
| CN | 109087609 | A | 12/2018 |
| CN | 110619851 | A | 12/2019 |
| CN | 111599313 | A | 8/2020 |

OTHER PUBLICATIONS

Office Action received for Japanese Patent Application No. 201910905348.8, dated Dec. 1, 2021, 28 pages (18 pages of English Translation and 10 pages of Original Document).

Office Action received for Japanese Patent Application No. 201910905348.8, dated Jul. 2, 2020, 30 pages (17 pages of English Translation and 13 pages of Original Document).

Office Action received for Japanese Patent Application No. 201910905348.8, dated May 10, 2021, 37 pages (21 pages of English Translation and 16 pages of Original Document).

Office Action received for Japanese Patent Application No. 201910905348.8, dated Sep. 9, 2021, 30 pages (17 pages of English Translation and 13 pages of Original Document).

* cited by examiner

PIXEL CIRCUIT, DRIVING METHOD AND DISPLAY DEVICE

CROSS-REFERENCE TO RELATED APPLICATIONS

This application is National stage of International Application No. PCT/CN2020/116141, filed on Sep. 18, 2020, which claims priority to Chinese Patent Application No. 201910905348.8, filed on Sep. 24, 2019, the entire contents of which are incorporated herein by reference.

FIELD

Embodiments of the present disclosure relate to the technical field of display, in particular to a pixel circuit, a driving method and a display device.

BACKGROUND

Organic light emitting diode (OLED) panels are widely concerned because of flexibility, high contrast, low power consumption and the like. An OLED in an OLED panel is driven to emit light by a current generated by a driving transistor in a pixel circuit.

SUMMARY

Embodiments of the present disclosure provide a pixel circuit, a driving method and a display device.

In accordance with one aspect of an embodiment of the present disclosure, provided is a pixel circuit including:

a signal input sub-circuit, configured to write a voltage of a data signal end, a voltage of a reference voltage signal end and a threshold voltage of a driving transistor into a gate electrode of the driving transistor according to a signal of a first control signal end, a signal of a second control signal end and a signal of a third control signal end;

a threshold compensation sub-circuit, configured to enable the gate electrode of the driving transistor to be connected with a drain electrode of the driving transistor under the control of a signal of a reset signal end; and a light emitting control sub-circuit, configured to provide a signal of a first power end to the drain electrode of the driving transistor under the control of a first light emitting control signal end; and enable a first electrode of a light emitting device to be connected with a source electrode of the driving transistor under the control of a second light emitting control signal end to drive the light emitting device to emit light.

In some embodiments, the signal input sub-circuit includes: a first switching transistor, a second switching transistor, a third switching transistor and a first capacitor; wherein a gate electrode of the first switching transistor is electrically connected with the first control signal end, a first electrode of the first switching transistor is electrically connected with the reference voltage signal end, and a second electrode of the first switching transistor is electrically connected with a first electrode of the first capacitor;

a gate electrode of the second switching transistor is electrically connected with the second control signal end, a first electrode of the second switching transistor is electrically connected with a source electrode of the driving transistor, and a second electrode of the second switching transistor is electrically connected with the data signal end;

a gate electrode of the third switching transistor is electrically connected with the third control signal end, a first electrode of the third switching transistor is electrically connected with the first electrode of the first capacitor, and a second electrode of the third switching transistor is electrically connected with the drain electrode of the driving transistor; and a second electrode of the first capacitor is electrically connected with the gate electrode of the driving transistor.

In some embodiments, the signal input sub-circuit includes: a fourth switching transistor, a fifth switching transistor, a sixth switching transistor and a second capacitor; wherein a gate electrode of the fourth switching transistor is electrically connected with the first control signal end, a first electrode of the fourth switching transistor is electrically connected with the data signal end, and a second electrode of the fourth switching transistor is electrically connected with a first electrode of the light emitting device;

a gate electrode of the fifth switching transistor is electrically connected with the second control signal end, a first electrode of the fifth switching transistor is electrically connected with the source electrode of the driving transistor, and a second electrode of the fifth switching transistor is electrically connected with the reference voltage signal end; and a gate electrode of the sixth switching transistor is electrically connected with the third control signal end, a first electrode of the sixth switching transistor is electrically connected with a first electrode of the second capacitor, and a second electrode of the sixth switching transistor is electrically connected with the source electrode of the driving transistor.

In some embodiments, the threshold compensation sub-circuit includes a seventh switching transistor, wherein a gate electrode of the seventh switching transistor is electrically connected with the reset signal end, a first electrode of the seventh switching transistor is electrically connected with the gate electrode of the driving transistor, and a second electrode of the seventh switching transistor is electrically connected with the drain electrode of the driving transistor.

In some embodiments, the light emitting control sub-circuit includes an eighth switching transistor and a ninth switching transistor;

a gate electrode of the eighth switching transistor is electrically connected with the first light emitting control signal end, a first electrode of the eighth switching transistor is electrically connected with the first power end, and a second electrode of the eighth switching transistor is electrically connected with the drain electrode of the driving transistor; and a gate electrode of the ninth switching transistor is electrically connected with the second light emitting control signal end, a first electrode of the ninth switching transistor is electrically connected with the drain electrode of the driving transistor, and a second electrode of the ninth switching transistor is electrically connected with the first electrode of the light emitting device.

In some embodiments, the pixel circuit further includes: an anode reset sub-circuit; and the anode reset sub-circuit is configured to enable the first electrode of the light emitting device to be connected with the reference voltage signal end under the control of the first control signal end.

In some embodiments, the anode reset sub-circuit includes: a tenth switching transistor; and a gate electrode of the tenth switching transistor is electrically connected with the first control signal end, a first electrode of the tenth switching transistor is electrically connected with the first electrode of the light emitting device, and a second electrode of the tenth light emitting transistor is electrically connected with the reference voltage signal end.

In some embodiments, the first control signal end and/or the second control signal end, and the reset signal end are the same signal end.

In some embodiments, the first control signal end and the second control signal end are the same signal end.

In some embodiments, the third control signal end and the second light emitting control signal end are the same signal end.

In accordance with another aspect of an embodiment of the present disclosure, provided is a display device including any pixel circuit described above according to embodiments of the present disclosure.

In accordance with further aspect of an embodiment of the present disclosure, provided is a driving method of a pixel circuit according to an embodiment of the present disclosure, including:

at a reset stage, applying a signal of a first level to the reset signal end, applying a signal of the first level to the first light emitting control signal end, applying a signal of a second level to the second light emitting control signal end, and applying a signal of the second level to the third control signal end;

at a data input stage, applying a signal of the first level to the reset signal end, applying a signal of the first level to the first control signal end, applying a signal of the first level to the second control signal end, applying a signal of the second level to the third control signal end, applying a signal of the second level to the first light emitting control signal end, and applying a signal of the second level to the second light emitting control signal end; and at a light emitting stage, applying a signal of the second level to the reset signal end, applying a signal of the second level to the first control signal end, applying a signal of the second level to the second control signal end, applying a signal of the first level to the third control signal end, applying a signal of the first level to the first light emitting control signal end, and applying a signal of the first level to the second light emitting control signal end.

In some embodiments, the method further includes: at the reset phase: applying a signal of the first level to the first control signal end, and applying a signal of the first level to the second control signal end.

In some embodiments, the method further includes: applying a signal of the second level to the first control signal end, and applying a signal of the second level to the second control signal end.

DETAILED DESCRIPTION OF THE EMBODIMENTS

Figure 1:
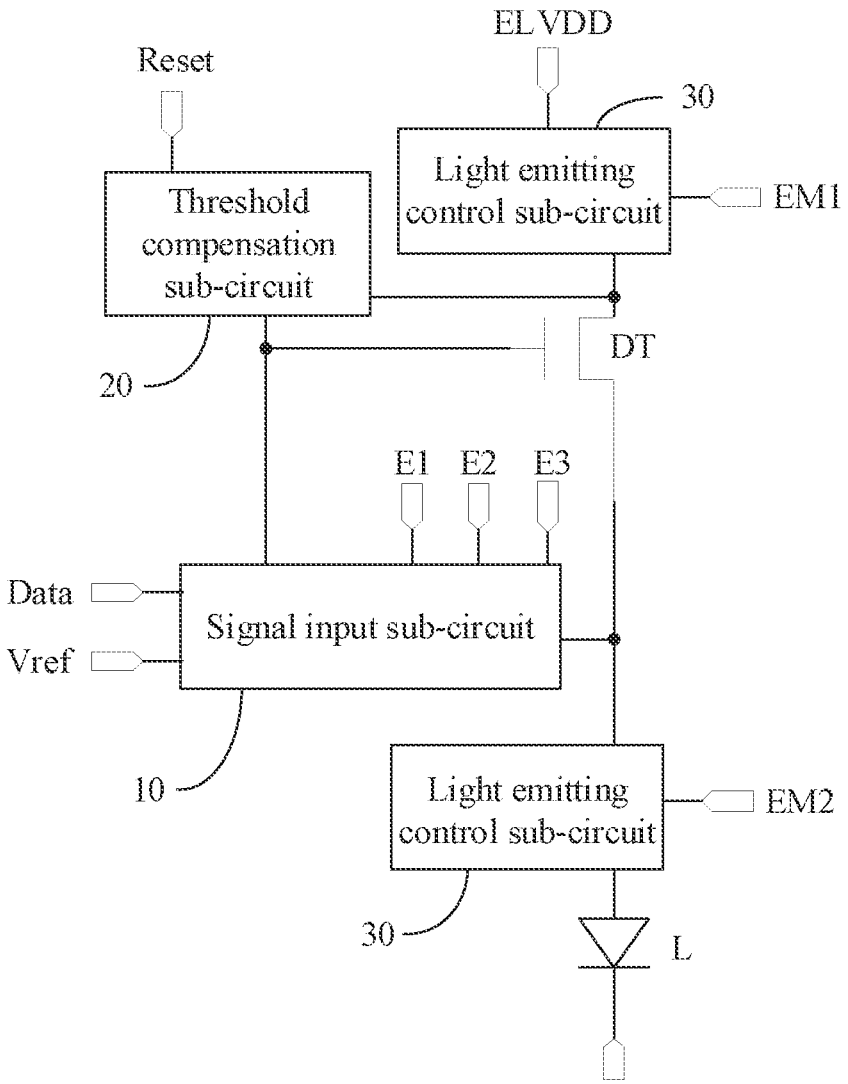
FIG. 1 is an exemplary structure diagram of a pixel circuit according to an embodiment of the present disclosure.

To make the objectives, technical solutions and advantages of embodiments of the present disclosure clearer, embodiments of the present disclosure will be further described in detail below in combination with the accompanying drawings. It is obvious that the disclosed embodiments are merely a part, and not all, of the disclosed embodiments. All other embodiments, which can be derived by one of ordinary skill in the art from embodiments disclosed herein without making any creative effort, shall fall within the scope of the present disclosure.

The shapes and sizes of all the components in the drawings are not to scale and are merely illustrative of the contents of embodiments of the present disclosure.

As shown in FIG. 1, a pixel circuit according to an embodiment of the present disclosure may include: a signal input sub-circuit 10, a threshold compensation sub-circuit 20, a light emitting control sub-circuit 30, a driving transistor DT and a light emitting device L.

The signal input sub-circuit 10 is electrically connected with a first control signal end E1, a second control signal end E2, a third control signal end E3, a data signal end Data, a reference voltage signal end Vref and a source electrode of the driving transistor DT respectively, and is configured to write a voltage Vdata of the data signal end Data, a voltage VREF of the reference voltage signal end Vref and a threshold voltage Vth of the driving transistor DT into a gate electrode of the driving transistor DT according to a signal of the first control signal end E1, a signal of the second control signal end E2 and a signal of the third control signal end E3.

The threshold compensation sub-circuit 20 is electrically connected with a reset signal end Reset, the gate electrode of the driving transistor DT and a drain electrode of the driving transistor DT respectively. The threshold compensation sub-circuit 20 is configured to enable the gate electrode of the driving transistor DT to be connected with the drain electrode of the driving transistor DT under the control of a signal of the reset signal end Reset.

The light emitting control sub-circuit 30 is electrically connected with a first power end ELVDD, a first light emitting control end EM1, a second light emitting control end EM2, the drain electrode of the driving transistor DT and a first electrode of a light emitting device L respectively. The light emitting control sub-circuit 30 is configured to provide a signal of the first power end ELVDD to the drain electrode of the driving transistor DT under the control of a signal of the first light emitting control signal end EM1; and enable the first electrode of the light emitting device L to be connected with the source electrode of the driving transistor DT under the control of the second light emitting control signal end EM2.

According to the pixel circuit provided by some embodiments of the present disclosure, the threshold voltage of the driving transistor DT may be compensated through mutual cooperation of the above-mentioned sub-circuits and the elements, so that a driving current for driving the light emitting device L to emit light is irrelevant to the threshold voltage of a driving sub-circuit, and the problem of uneven light emitting brightness caused by uneven threshold voltage is solved. Moreover, through mutual cooperation of the above-mentioned sub-circuits and the elements, the voltage of the first power end ELVDD may be compensated, so that the driving current for driving the light emitting device is irrelevant to the voltage of the first power end ELVDD, and the problem of uneven light emitting brightness caused by IR Drop of the first power end ELVDD may be solved.

Some embodiments of the present disclosure will be described in detail below in combination with specific embodiments. It should be noted that, embodiments of the present disclosure are better explained, but the embodiments of the present disclosure are not limited.

Figure 3:
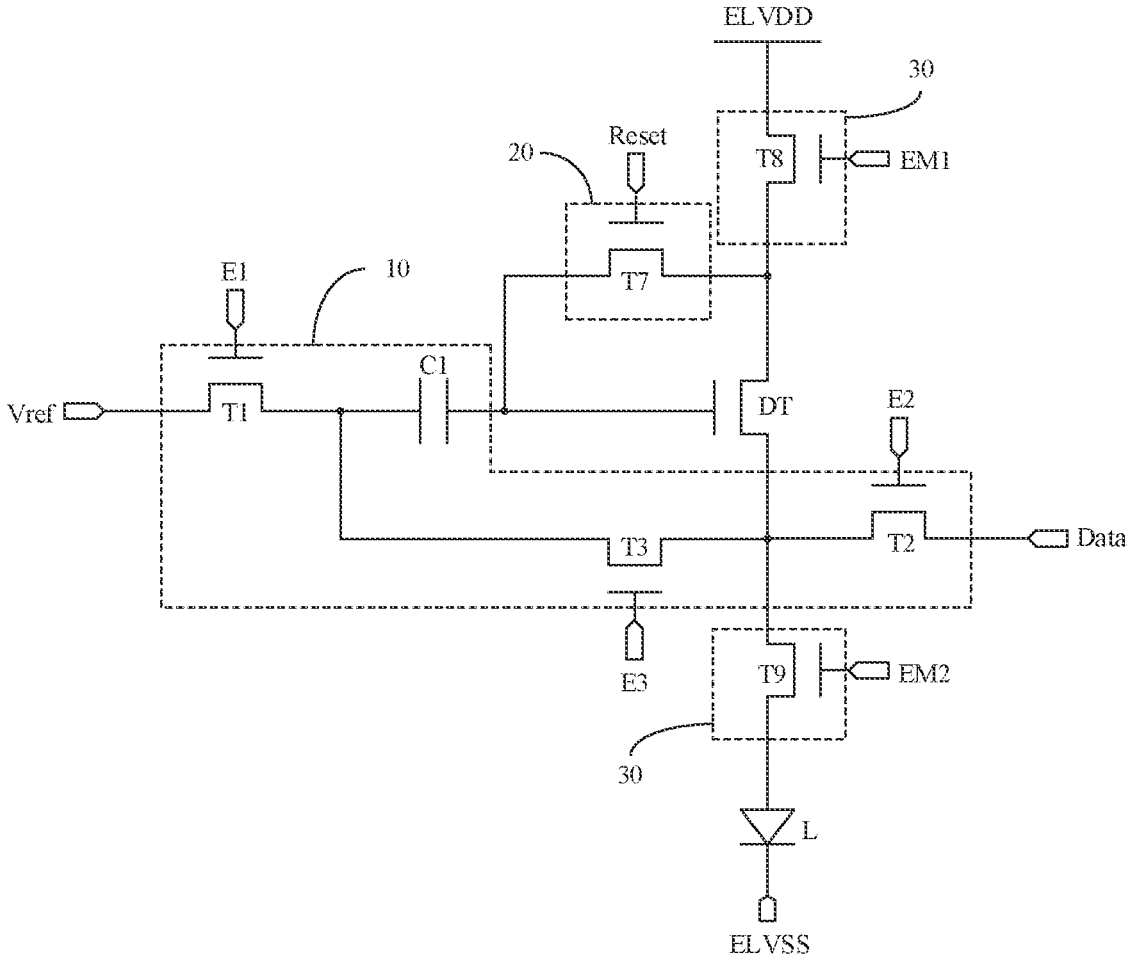
FIG. 3 is an exemplary circuit structure diagram of the pixel circuit according to an embodiment of the present disclosure.
Figure 4:
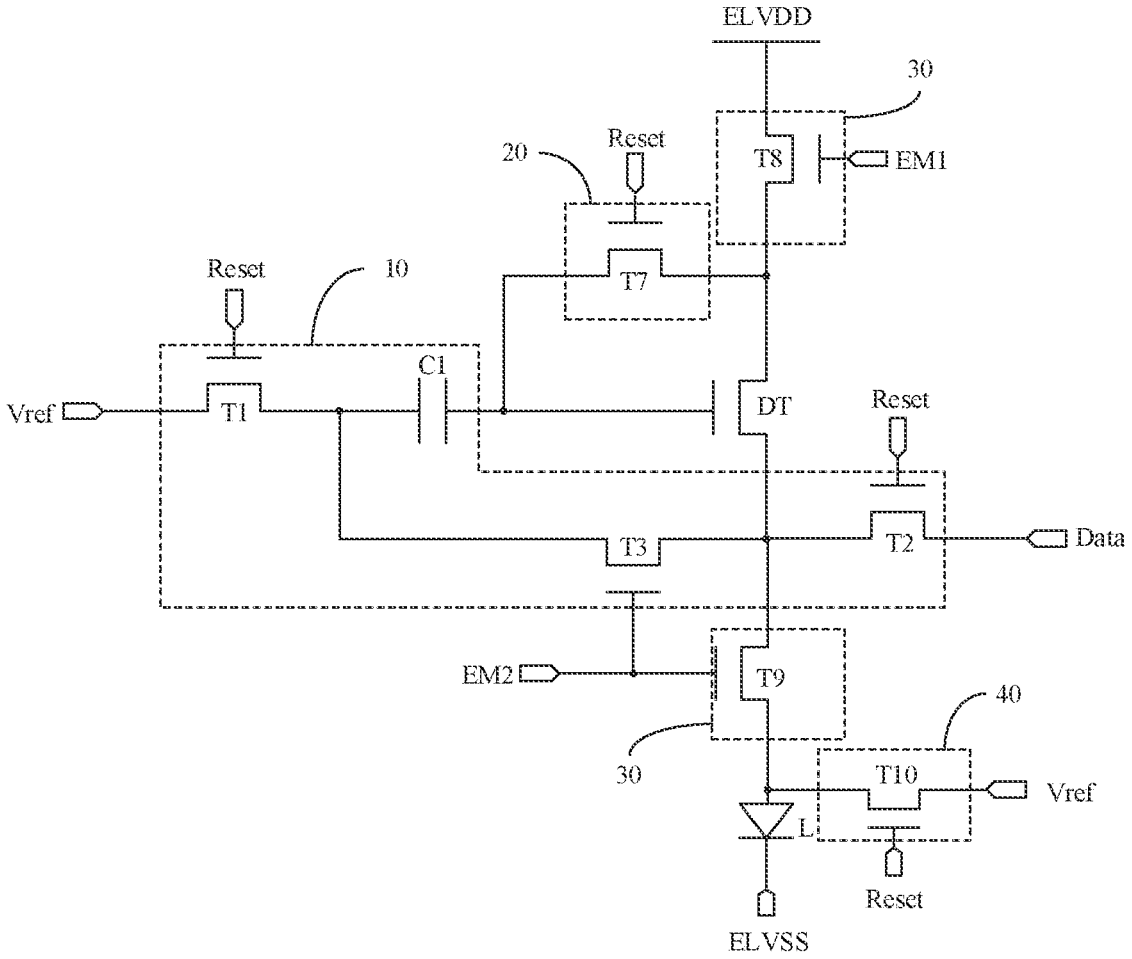
FIG. 4 is another exemplary circuit structure diagram of the pixel circuit according to an embodiment of the present disclosure.
Figure 8:
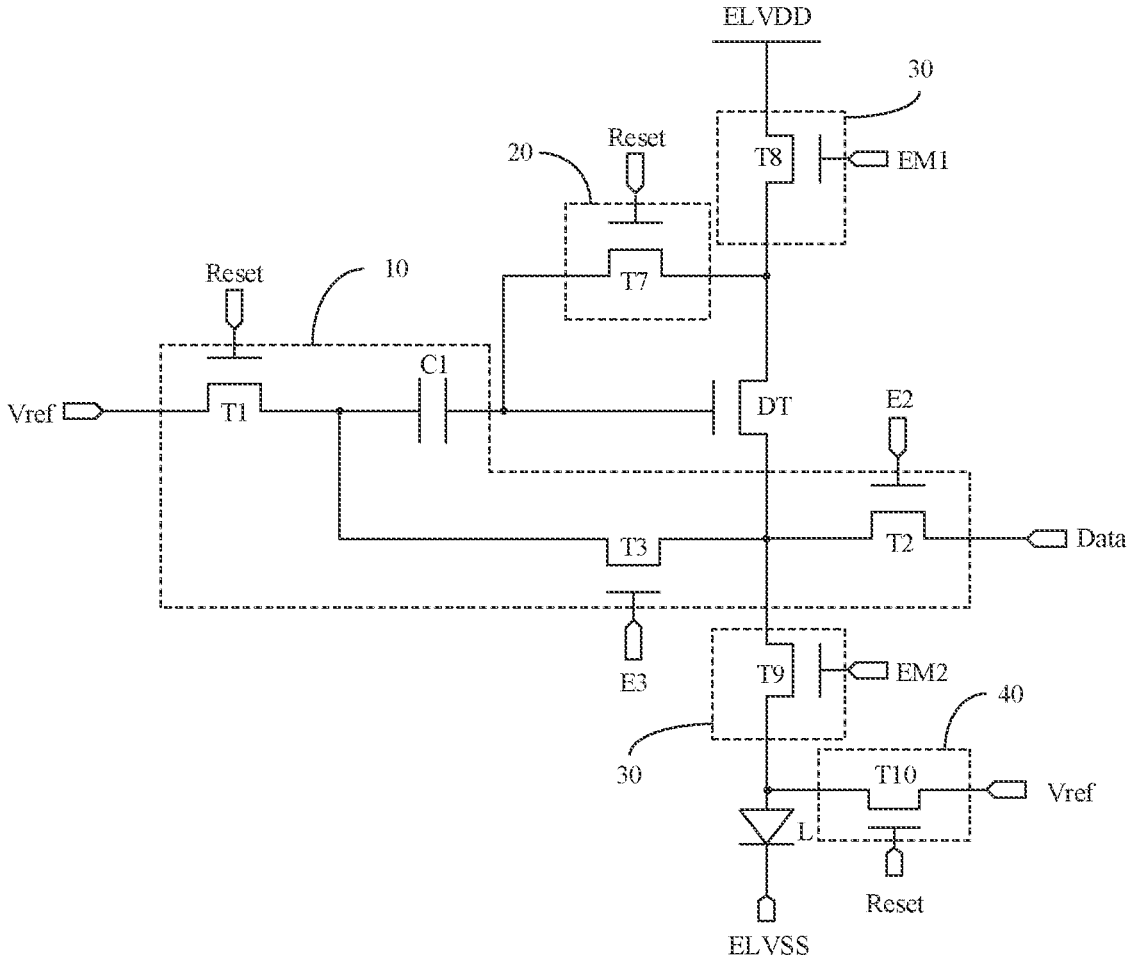
FIG. 8 is yet further another exemplary circuit structure diagram of the pixel circuit according to an embodiment of the present disclosure.

In the pixel circuit provided by some embodiments of the present disclosure, as shown in FIG. 3, FIG. 4 and FIG. 8, the driving transistor DT may be an N-type transistor, and for the case that the driving transistor DT is a P-type transistor, the design principle is the same as that of embodiments of the present disclosure, and it also belongs to the scope of protection of embodiments of the present disclosure.

In the pixel circuit provided by some embodiments of the present disclosure, a first end of the light emitting device L is electrically connected with the light emitting control sub-circuit, and a second end of the light emitting device L is electrically connected with a second power end ELVSS. Moreover, the light emitting device L may be at least one of an organic light emitting diode (OLED) and a quantum dot light emitting diode (QLED). For example, when the light emitting device L is the OLED, the anode of the OLED is the first end of the light emitting device L and the cathode is the second end of the light emitting device L.

In the pixel circuit provided by some embodiments of the present disclosure, as shown in FIG. 3, FIG. 4 and FIG. 8, the signal input sub-circuit 10 may include: a first switching transistor T1, a second switching transistor T2, a third switching transistor T3 and a first capacitor CI. A gate electrode of the first switching transistor T1 is electrically connected with the first control signal end E1, a first electrode of the first switching transistor T1 is electrically connected with the reference voltage signal end Vref, and a second electrode of the first switching transistor T1 is electrically connected with a first electrode of the first capacitor C1.

A gate electrode of the second switching transistor T2 is electrically connected with the second control signal end E2, a first electrode of the second switching transistor T2 is electrically connected with the source electrode of the driving transistor DT, and a second electrode of the second switching transistor T2 is electrically connected with the data signal end Data.

A gate electrode of the third switching transistor T3 is electrically connected with the third control signal end E3, a first electrode of the third switching transistor T3 is electrically connected with the first electrode of the first capacitor C1, and a second electrode of the third switching transistor T3 is electrically connected with the source electrode of the driving transistor DT.

A second electrode of the first capacitor C1 is electrically connected with the gate electrode of the driving transistor DT.

In the pixel circuit provided by some embodiments of the present disclosure, when the first switching transistor T1 is in a switch-on state under the control of a signal of the first control signal end E1, a signal of the reference voltage signal end Vref may be provided to the first electrode of the first capacitor C1. When the second switching transistor T2 is in a switch-on state under the control of a signal of the second control signal end E2, a signal of the data signal end Data may be provided to the source electrode of the driving transistor DT; and when the third switching transistor T3 is in a switch-on state under the control of a signal of the third control signal end E3, the source electrode of the driving transistor DT may be connected with the first electrode of the first capacitor C1. The first capacitor C1 is configured to store a voltage input to the first electrode of the first capacitor C1 and the second electrode of the first capacitor C1.

As shown in FIG. 3 to FIG. 8, in an exemplary pixel circuit according to some embodiments of the present disclosure, the threshold compensation sub-circuit 20 may include: a seventh switching transistor T7. A gate electrode of the seventh switching transistor T7 is electrically connected with the reset signal end Reset, a first electrode of the seventh switching transistor T7 is electrically connected with the gate electrode of the driving transistor DT and the second electrode of the capacitor, and a second electrode of the seventh switching transistor T7 is electrically connected with a second electrode of the eighth switching transistor T8 and the drain electrode of the driving transistor DT.

For example, when the seventh switching transistor T7 is in a switch-on state under the control of a signal of the reset signal end Reset, the drain electrode of the driving transistor DT may be connected with the gate electrode of the driving transistor DT, so that the driving transistor DT forms a diode structure.

As shown in FIG. 3 to FIG. 8, the light emitting control sub-circuit 30 may include: an eighth switching transistor T8 and a ninth switching transistor T9. A gate electrode of the eighth switching transistor T8 is electrically connected with the first light emitting control signal end EM1, a first electrode of the eighth switching transistor T8 is electrically connected with the first power end ELVDD, and a second electrode of the eighth switching transistor T8 is electrically connected with the second electrode of the seventh switching transistor T7 and the drain electrode of the driving transistor DT.

A gate electrode of the ninth switching transistor T9 is electrically connected with the second light emitting control signal end EM2, a first electrode of the ninth switching transistor T9 is electrically connected with the source electrode of the driving transistor DT, the first electrode of the second switching transistor T2 and the second electrode of the third switching transistor T3, and a second electrode of the ninth switching transistor T9 is electrically connected with the first electrode of the light emitting device L.

Figure 2:
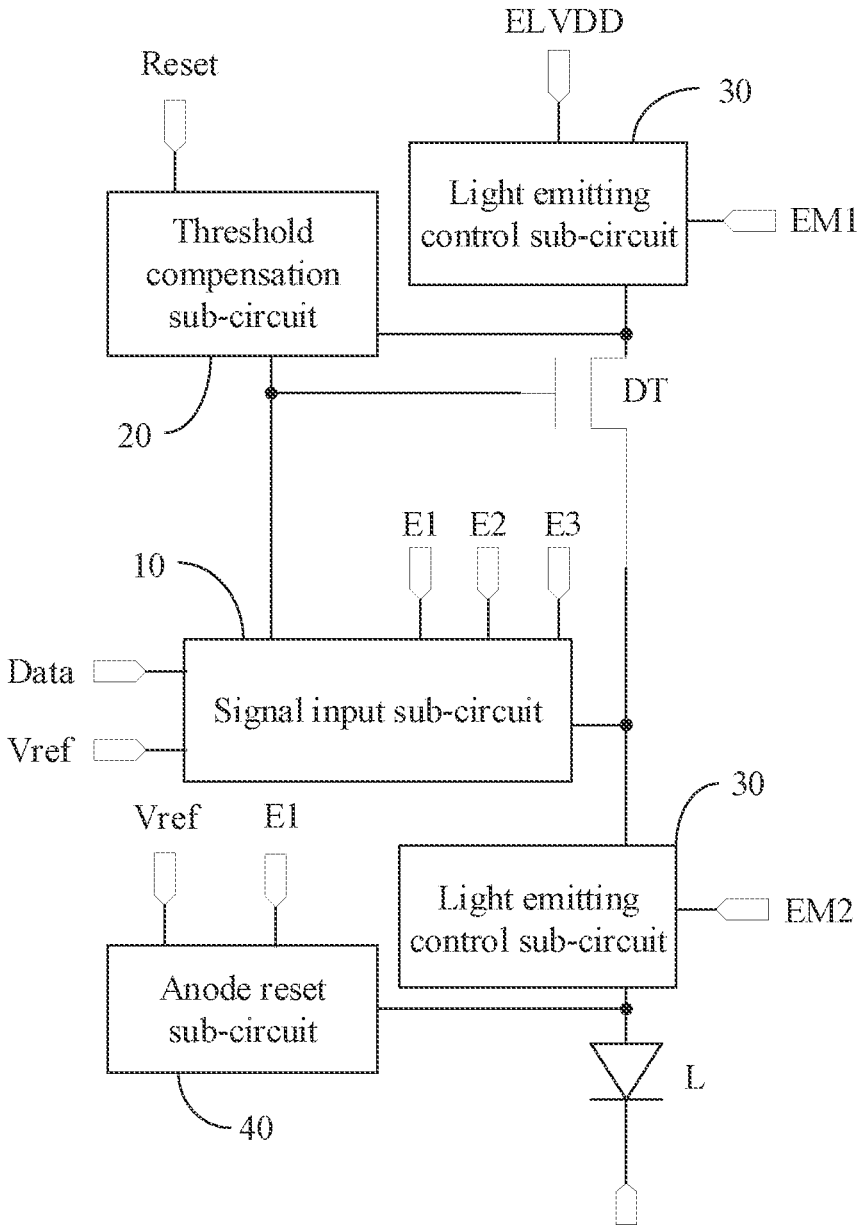
FIG. 2 is another exemplary structure diagram of the pixel circuit according to an embodiment of the present disclosure.

As shown in FIG. 2 and FIG. 4, the pixel circuit according to some embodiments of the present disclosure may further include an anode reset sub-circuit 40. The anode reset sub-circuit 40 is electrically connected with the first control signal end E1, the reference voltage signal end Vref and the first electrode of the light emitting device L respectively. The anode reset sub-circuit 40 is configured to enable the first electrode of the light emitting device L to be connected with the reference voltage signal end Vref under the control of the signal of the first control signal end E1. For example, the anode reset sub-circuit 40 includes a tenth switching transistor T10. A gate electrode of the tenth switching transistor T10 is electrically connected with the first control signal end E1, a first electrode of the tenth switching transistor T10 is electrically connected with the reference voltage signal end Vref, and a second electrode of the tenth switching transistor T10 is electrically connected with the second electrode of the ninth switching transistor T9 and the first electrode of the light emitting device L. When the tenth switching transistor T10 is in a switch-on state under the control of the signal of the first control signal end E1, the voltage VREF of the reference voltage signal end Vref may be provided to the first end of the light emitting device L so as to reset the light emitting device L.

For example, a voltage VDD of the first power end may be a positive value, and a voltage VSS of the second power end may be grounded or a negative value. Moreover, a voltage VDD of a first voltage source ELVDD, the voltage VREF of the reference signal end Vref, the threshold voltage Vth of the driving transistor DT and the voltage Vdata of the data signal end Data meet the following relation: VDD>(VREF+Vth)>Vdata. Of course, the specific voltage values of the above-mentioned voltages may be designed and determined according to an actual application environment, and are not limited herein.

In order to reduce the number of signal ends, lower the complexity and reduce the occupied space of a signal line, the third control signal end E3 and the second light emitting control signal end EM2 may be set as the same signal end. For example, as shown in FIG. 4, the gate electrode of the third switching transistor T3 is electrically connected to the second light emitting control signal end EM2.

The first control signal end E1 and the reset signal end Reset may be the same signal end. For example, as shown in FIG. 4 and FIG. 8, the gate electrode of the first switching transistor T1 is electrically connected to the reset signal end Reset.

The second control signal end E2 and the reset signal end Reset may be the same signal end. For example, as shown in FIG. 4, the gate electrode of the second switching transistor T2 is electrically connected to the reset signal end Reset.

The first control signal end E1 and the second control signal end E2 may also be the same signal end. For example, as shown in FIG. 4, the first control signal end E1 and the second control signal end E2 are electrically connected with the reset signal end Reset.

The specific structures of various sub-circuits in the pixel circuit provided by some embodiments of the present disclosure are only exemplified as above, and the specific structures of the above-mentioned various sub-circuit are not limited to the above-mentioned structures provided by some embodiments of the present disclosure, can also be other structures known to those skilled in the art, and are not limited herein.

In order to unify manufacturing processes, in the pixel circuit provided by some embodiments of the present disclosure, as shown in FIG. 3, FIG. 4 and FIG. 8, all the transistors may be N-type transistors. Of course, all the transistors may also be P-type transistors, and are not limited herein.

In the pixel circuit provided by some embodiments of the present disclosure, the P-type transistor is switched on under the action of a low-level signal and is switched off under the action of a high-level signal; and the N-type transistor is switched on under the action of a high-level signal and is switched off under the action of a low-level signal.

In the pixel circuit provided by some embodiments of the present disclosure, each of the above-mentioned transistors may be a thin film transistor (TFT) or a metal oxide semiconductor (MOS) field effect transistor, and is not limited herein. According to different types of the above-mentioned transistors and different signals of the gate electrodes of the transistors, the first electrode of the above-mentioned switching transistor may be used as a source electrode and the second electrode of the switching transistor may be used as a drain electrode or the first electrode of the switching transistor may be used as the drain electrode and the second electrode of the switching transistor may be used as the source electrode, and no specific distinction is made herein.

A working process of the pixel circuit provided by some embodiments of the present disclosure is described below in combination with a circuit timing diagram. In the following description, a high potential is represented by 1 and a low potential is represented by 0. It should be noted that 1 and 0 are logic potentials only to better explain the specific working process of the embodiment of the present disclosure, but not the specific voltage values.

Figure 9:
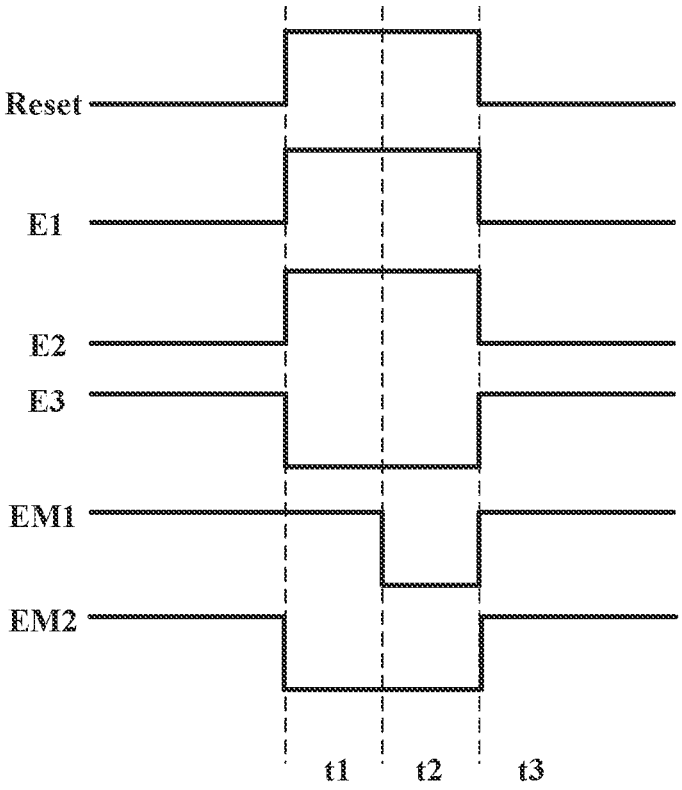
FIG. 9 is a signal timing diagram of the pixel circuit shown in FIG. 3.

The working process of the above-mentioned pixel circuit provided by some embodiments of the present disclosure is described below by taking the pixel circuit shown in FIG. 3 as an example in combination with the circuit signal timing diagram shown in FIG. 9. For example, there are three stages t1, t2 and t3 in the input timing diagram shown in FIG. 9.

At the stage t1, Reset=1, E1=1, E2=1, E3=0, EM1=1 and EM2=0.

The seventh switching transistor T7 is switched on due to Reset=1; the first switching transistor T1 is switched on due to E1=1; the second switching transistor T2 is switched on due to E2=1; the third switching transistor T3 is switched off due to E3=0; the ninth switching transistor T9 is switched off due to EM2=0; and the eighth switching transistor T8 is switched on due to EM1=1.

Therefore, the voltage VREF of the reference voltage signal end Vref is output to the first electrode of the first capacitor C1 through the first switching transistor T1 and is stored in the first capacitor C1, the voltage Vdata of the data signal end Data is output to the source electrode of the driving transistor DT through the second switching transistor T2, the voltage VDD of the first power end ELVDD is output to the drain electrode of the driving transistor DT through the eighth switching transistor T8, and the voltage VDD of the first power end ELVDD is output to the gate electrode of the driving transistor DT through the eighth switching transistor T8 and the seventh switching transistor T7 and is stored in the first capacitor C1.

At the stage t2, Reset=1, E1=1, E2=1, E3=0, EM1=0 and EM2=0. Therefore, the eighth switching transistor T8 is switched off, and the other switching transistors maintain the state at the stage T1.

The voltage Vdata of the data signal end Data is output to the source electrode of the driving transistor DT through the second switching transistor T2. The seventh switching transistor T7 is switched on, the gate electrode and the drain electrode of the driving transistor DT are switched on, so that the driving transistor DT forms a diode structure, and the first capacitor C1 discharges. When the gate voltage of the driving transistor DT is discharged to Vdata+Vth, the driving transistor DT is switched off, so the gate voltage of the driving transistor DT is Vdata+Vth finally, and Vdata and Vth are written into the gate electrode of the driving transistor DT.

At the stage t3, Reset=0, E1=0, E2=0, E3=1, EM1=1 and EM2=1.

The seventh switching transistor T7 is switched off due to Reset=0; the first switching transistor T1 is switched off due to E1=0; the second switching transistor T2 is switched off due to E2=0; the third switching transistor T3 is switched on due to E3=1; the eighth switching transistor T8 is switched on due to EM1=1; and the ninth switching transistor T9 is switched on due to EM2=1.

The third switching transistor T3 is switched on, the source electrode of the driving transistor DT is connected with the first electrode of the first capacitor C1, and the source voltage of the driving transistor DT is Vs, so that the voltage of the first electrode of the first capacitor C1 is changed from VREF to Vs. Because of conservation of electricity of the first capacitor C1, the gate voltage Vg of the driving transistor DT becomes: Vdata+Vth+Vs−VREF. The driving transistor DT is in a saturated state, an output driving current I flows to the first electrode of the light emitting device L through the ninth switching transistor T9, and the light emitting device L is driven by the driving current I to emit light.

At the stage T3, the gate voltage of the driving transistor DT is as follows: Vg=Vdata+Vth+Vs−VREF, and a voltage difference of the gate electrode and the source electrode of the driving transistor DT is as follows: Vgs=Vg−Vs=Vdata+Vth+Vs−VREF−Vs=Vdata+Vth−VREF.

A formula of the driving current I is as follows: $I=K(Vgs-Vth)^2=K(Vdata-VREF)^2$, wherein $$K = \frac{1}{2}\mu_n C_{ox}\frac{W}{L},$$

μn represents the mobility of the driving transistor DT, Cox represents the gate oxide layer capacitance per unit area, $$\frac{W}{L}$$

represents a width-length ratio of the driving transistor DT, and the numerical values in the same structure are relatively stable and may be calculated as constants.

As can be seen from the above formula, at the moment, the driving current I output by the driving transistor DT has been already irrelevant to the threshold voltage Vth of the driving transistor DT and the first voltage source ELVDD, and is only relevant to the voltage Vdata of the data signal end Data and the voltage VREF of the reference voltage signal end Vref, so that the problems of threshold voltage drift and voltage drop of the first voltage source ELVDD due to the process and the long-time operation of the driving transistor DT are solved, and then, the display effect is improved.

Figure 5:
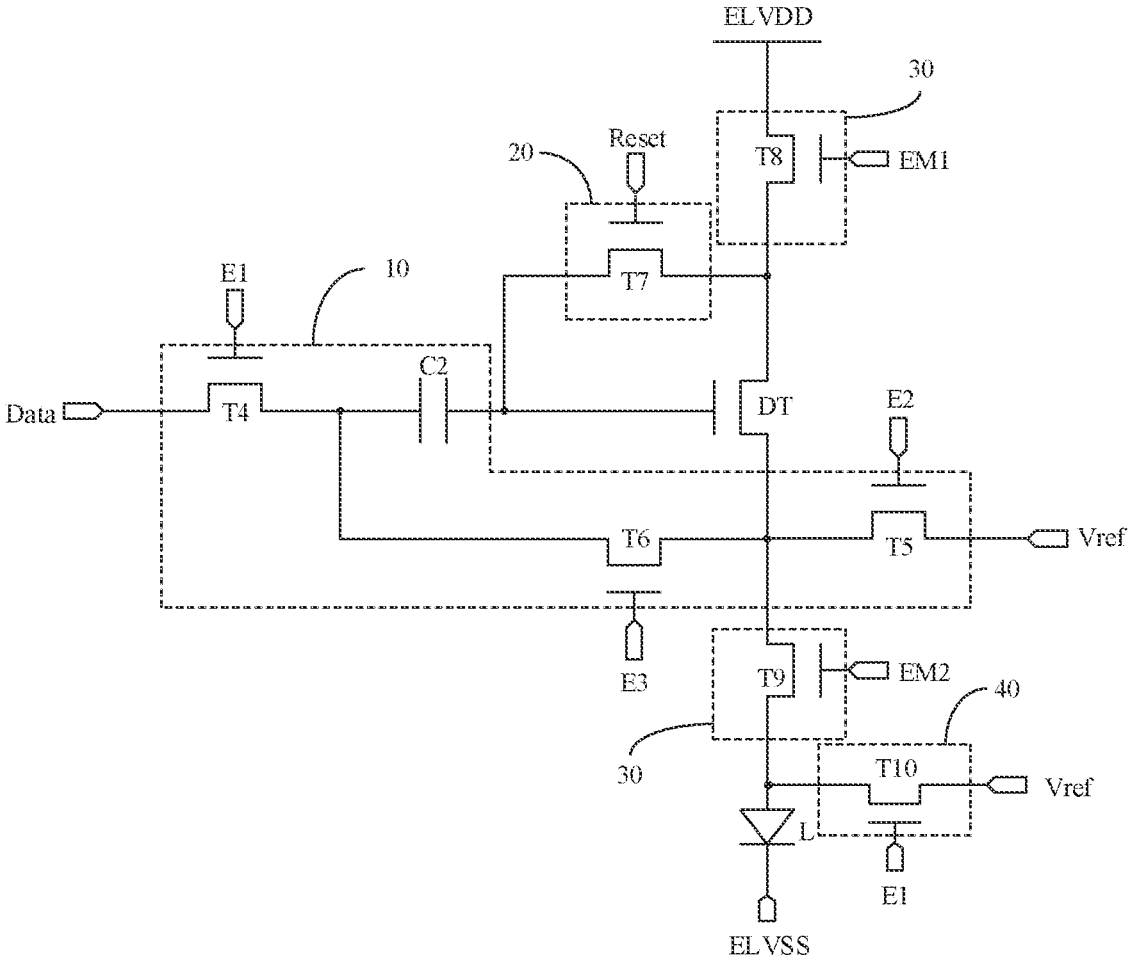
FIG. 5 is further exemplary circuit structure diagram of the pixel circuit according to an embodiment of the present disclosure.

A schematic structural diagram of an exemplary pixel circuit according to some embodiments of the present disclosure is shown in FIG. 5, which is modified with respect to some implementation modes of the above-mentioned embodiments. Only differences of the present embodiment and the above-mentioned embodiments will be described below, and the same parts will not be described herein again.

In the pixel circuit provided by some embodiments of the present disclosure, as shown in FIG. 5, the signal input sub-circuit 10 may further include: a fourth switching transistor T4, a fifth switching transistor T5, a sixth switching transistor T6 and a second capacitor C2.

A gate electrode of the fourth switching transistor T4 is electrically connected with the first control signal end E1, a first electrode of the fourth switching transistor T4 is electrically connected with the data signal end Data, and a second electrode of the fourth switching transistor T4 is electrically connected with the first electrode of the second capacitor C2 and the first electrode of the sixth switching transistor T6 respectively.

A gate electrode of the fifth switching transistor T5 is electrically connected with the second control signal end E2, a first electrode of the fifth switching transistor T5 is electrically connected with the source electrode of the driving transistor DT, the first electrode of the ninth switching transistor T9 and the second electrode of the sixth switching transistor T6 respectively, and a second electrode of the fifth switching transistor T5 is electrically connected with the reference voltage signal end Vref.

A gate electrode of the sixth switching transistor T6 is electrically connected with the third control signal end E3, a first electrode of the sixth switching transistor T6 is electrically connected with the second electrode of the fourth switching transistor T4 and the first electrode of the second capacitor C2 respectively, and a second electrode of the sixth switching transistor T6 is electrically connected with the source electrode of the driving transistor DT, the first electrode of the fifth switching transistor T5 and the first electrode of the ninth switching transistor T9 respectively.

The first electrode of the second capacitor C2 is electrically connected with the second electrode of the fourth switching transistor T4 and the first electrode of the sixth switching transistor T6 respectively, and the second electrode the second capacitor C2 is electrically connected with the gate electrode of the driving transistor DT and the first electrode of the seventh switching transistor T7 respectively.

In the pixel circuit provided by some embodiments of the present disclosure, when the fourth switching transistor T4 is in a switch-on state under the control of the first control signal end E1, the voltage Vdata of the data signal end Data may be provided to the first electrode of the second capacitor C2; and when the fifth switching transistor T5 is in a switch-on state under the control of the second control signal end E2, the voltage VREF of the reference voltage signal end Vref may be provided to the source electrode of the driving transistor DT. When the sixth switching transistor T6 is in a switch-on state under the control of the third control signal end E3, the source electrode of the driving transistor DT may be connected with the first electrode of the second capacitor C2; and the second capacitor C2 is configured to store a voltage input to the first electrode of the second capacitor C2 and the second electrode of the second capacitor C2.

Figure 11:
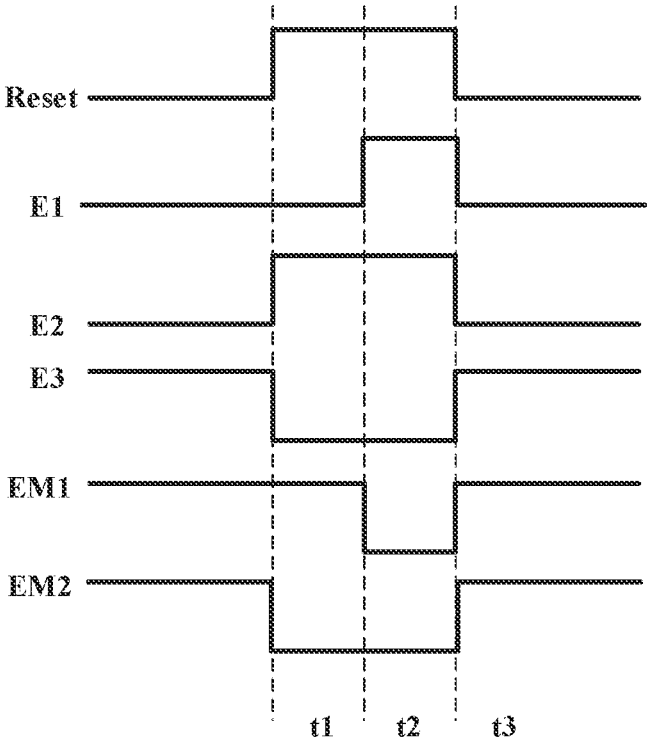
FIG. 11 is a signal timing diagram of the pixel circuit shown in FIG. 5.

The pixel circuit shown in FIG. 5 is taken as an example, a working process of the above-mentioned pixel circuit provided by the embodiment of the present disclosure is described in combination with the circuit signal timing diagram 11. Three stages t1, t2 and t3 in the input timing diagram shown in FIG. 11 are selected as an example.

At the stage t1, Reset=1, E1=0, E2=1, E3=0, EM1=1 and EM2=0.

The seventh switching transistor T7 is switched on due to Reset=1; the fourth switching transistor T4 is switched off and the tenth switching transistor is switched off due to E1=0; the fifth switching transistor T5 is switched on due to E2=1; the sixth switching transistor T6 is switched off due to E3=0; the eighth switching transistor T8 is switched on due to EM1=1; and the ninth switching transistor T9 is switched off due to EM2=0.

The voltage VDD of the first power end ELVDD is output to the gate electrode of the driving transistor DT through the eighth switching transistor T8 and the seventh switching transistor T7 and is stored in the second capacitor C2. Since the fifth switching transistor T5 is switched on, the voltage VREF of the reference voltage signal end Vref is provided to the source electrode of the driving transistor DT.

At the stage t2, Reset=1, E1=1, E2=1, E3=0, EM1=0 and EM2=0. Thus, the seventh switching transistor T7 is switched on, the fourth switching transistor T4 is switched on, the fifth switching transistor T5 is switched on, the tenth switching transistor T10 is switched on, the sixth switching transistor T6 is switched off, the eighth switching transistor T8 is switched off, and the ninth switching transistor T9 is switched off. Therefore, the voltage Vdata of the data signal end Data is written into the first electrode of the second capacitor C2 through the fourth switching transistor T4, the seventh switching transistor T7 is switched on, the gate electrode and the drain electrode of the driving transistor DT are switched on, so that the driving transistor DT forms a diode structure; and the tenth switching transistor T10 is switched on, so that the voltage VREF of the reference voltage signal end Vref is output to the first electrode of the light emitting device L to reset the light emitting device L. At the beginning of the stage, the voltage of the second electrode of the second capacitor C2 is the voltage VDD written at the stage t1, and the voltage VREF of the reference voltage end is output to the source electrode of the driving transistor DT through the fifth switching transistor T5. At the moment, a voltage difference of the gate electrode and the source electrode of the driving transistor DT is as follows: VDD-VREF, namely, the voltage Vgs of the driving transistor DT is as follows: VDD−VREF>Vth, and the driving transistor DT is switched on. When the gate voltage of the driving transistor DT is discharged to VREF+Vth, the voltage Vgs is VREF+Vth−VREF=Vth, and the driving transistor DT is switched off, so that the gate voltage of the driving transistor DT is finally VREF+Vth, wherein Vth is the threshold voltage of the driving transistor DT. At the moment, the voltage stored on the second capacitor C2 is Vdata−(VREF+Vth).

At the stage t3, Reset=0, E1=0, E2=0, E3=1, EM1=1 and EM2=1.

The seventh switching transistor T7 is switched off due to Reset=0; the fourth switching transistor T4 is switched off due to E1=0, and the fifth switching transistor T5 is switched off due to E2=0. The sixth switching transistor T6 is switched on due to E3=1, the ninth switching transistor T9 is switched on due to EM2=1, and the eighth switching transistor T8 is switched on due to EM1=1.

At the moment, the source voltage of the driving transistor DT is Vs, the sixth switching transistor T6 is switched on, and the voltage of the first electrode of the second capacitor C2 is changed from Vdata into Vs. Due to the bootstrap effect of the second capacitor C2, the gate voltage of the driving transistor DT is changed into: Vg=VREF+Vth+Vs−Vdata. The driving transistor DT is in a saturated state, the output driving current flows to the first electrode of the light emitting device L through the ninth switching transistor T9, and the light emitting device L emits light under the drive of the driving current.

At the stage t3, the gate voltage of the driving transistor DT is as follows: Vg=VREF+Vth+Vs−Vdata, and the voltage difference of the gate electrode and the source electrode of the driving transistor DT is as follows: Vgs=Vg−Vs=VREF+Vth+Vs−Vdata−Vs=VREF+Vth−Vdata. The formula of the driving current I is as follows: $I=K(Vgs-Vth)^2=K(VREF-Vdata)^2$.

As can be seen from the above formula, the driving current I output by the driving transistor DT at the moment is irrelevant to the threshold voltage Vth of the driving transistor DT, and when the driving transistor DT works in a saturation region, the driving current of the driving transistor DT is irrelevant to the voltage VDD of the first voltage source ELVDD. Therefore, according to the above-mentioned embodiments, the problem of threshold voltage drift of the driving transistor DT due to the process and long-time operation and the problem of uneven pixel brightness caused by voltage drop may be solved.

The pixel circuit shown in FIG. 4 is taken as an example, a working process of the above-mentioned pixel circuit provided by some embodiments of the present disclosure is described in combination with the circuit signal timing diagram 10. Only the differences of the present embodiment and the above-mentioned embodiments will be described below, and the same parts will not be described herein again.

Figure 10:
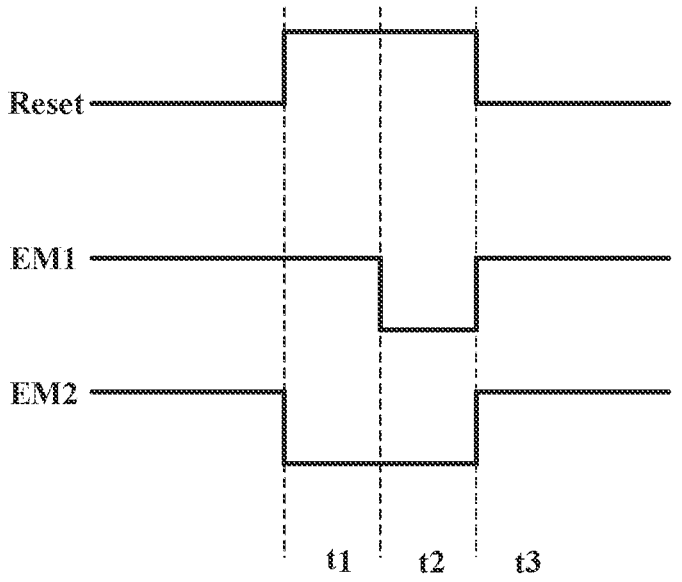
FIG. 10 is a signal timing diagram of the pixel circuit shown in FIG. 4.

Three stages t1, t2 and t3 in the input timing diagram as shown in FIG. 10 are taken as an example. As shown in FIG. 4, the reset signal end Reset, the first control signal end E1 and the second control signal end E2 may be the same end; and the second light emitting control signal end EM2 and the third control signal end E3 may be the same end.

At the stage t1, Reset=1, EM1=1 and EM2=0.

The tenth switching transistor T10 is switched on due to Reset=1, and thus, the voltage VREF of the reference signal end Vref is output to the first electrode of the light emitting device L through the tenth transistor T10 to reset the light emitting device L; and the light emitting device L does not emit light due to the fact that the voltage VREF is less than the light emitting voltage of the light emitting device L. The rest of the working process at the stage may be substantially the same as the working process of the pixel circuit at the stage t1 shown in FIG. 3, and will not be described herein again.

At the stage t2, Reset=1, EM1=0 and EM2=0.

The tenth switching transistor T10 is switched on due to Reset=1. Therefore, the voltage VREF of the reference signal end Vref is output to the first electrode of the light emitting device L through the tenth transistor T10 to reset the light emitting device L; and the light emitting device L does not emit light due to the fact that the voltage VREF is less than the light emitting voltage of the light emitting device L. The rest of the working process at the stage may be substantially the same as the working process of the pixel circuit at the stage t2 shown in FIG. 3, and will not be described herein again.

At the stage t3, Reset=0, EM1=1 and EM2=1.

The tenth switching transistor T10 is switched off due to Reset=0. The rest of the working process at the stage may be substantially the same as the working process at the stage t3 in the first embodiment, and will not be described herein again.

Figure 6:
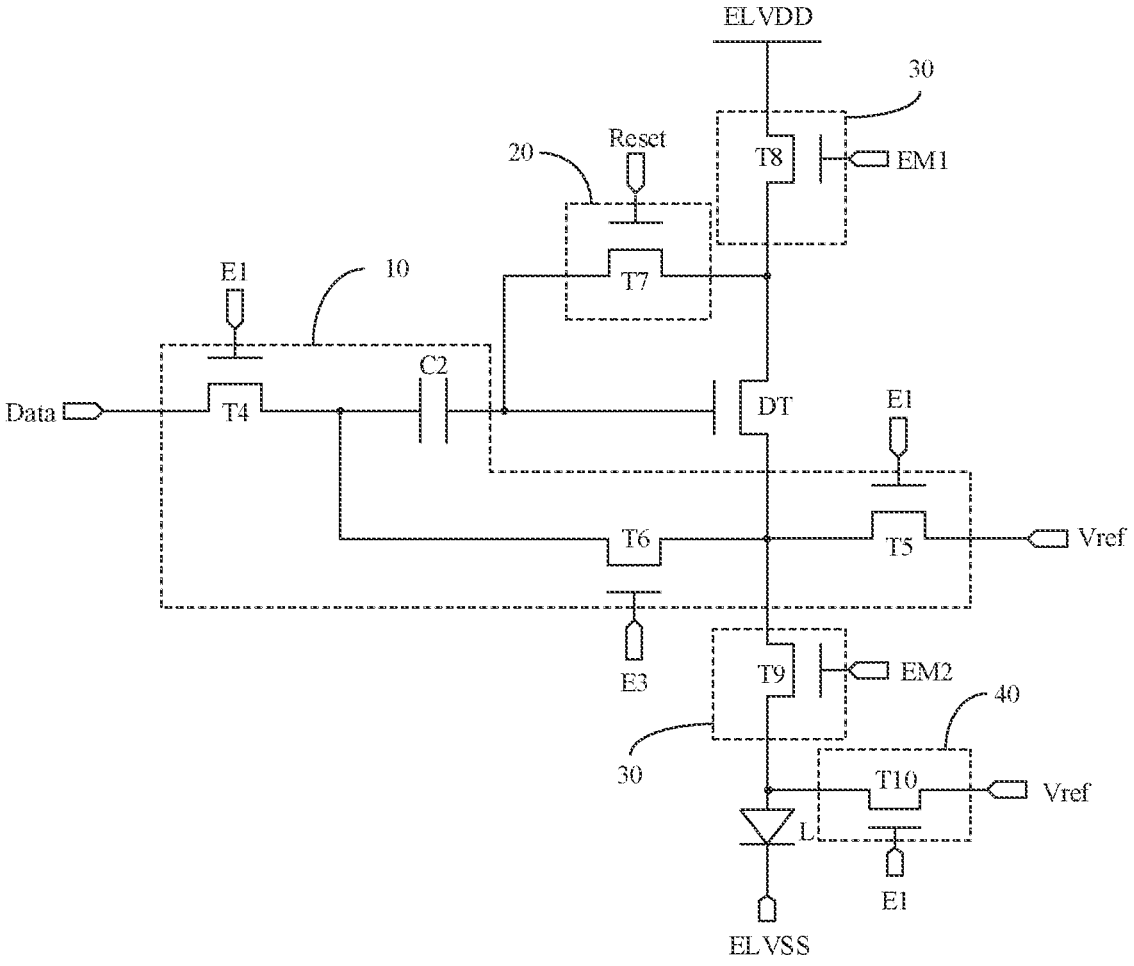
FIG. 6 is yet further exemplary circuit structure diagram of the pixel circuit according to an embodiment of the present disclosure.

The pixel circuit shown in FIG. 6 is taken as an example, a working process of the above-mentioned pixel circuit provided by some embodiments of the present disclosure is described in combination with the circuit signal timing diagram 12. Only the differences of the present embodiment and the above-mentioned embodiments will be described below, and the same parts will not be described herein again.

As shown in FIG. 6, the first control signal end E1 and the second control signal end E2 may be the same end.

Figure 12:
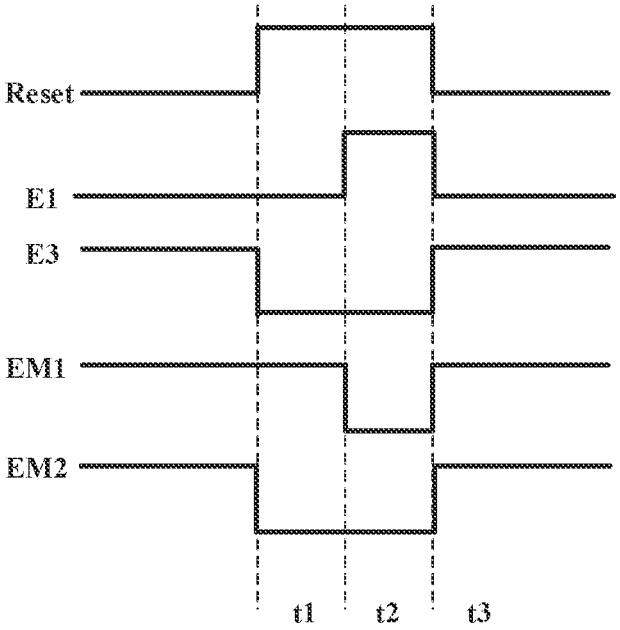
FIG. 12 is a signal timing diagram of the pixel circuit shown in FIG. 6.

Three stages t1, t2 and t3 in the input timing diagram shown in FIG. 12 are taken as an example.

At the stage t1, Reset=1, E1=0, E3=0, EM1=1 and EM2=0.

The fifth switching transistor T5 and the fourth switching transistor T4 are switched off due to E1=0, the rest of the working process at the stage may be substantially the same as the working process at the stage t1 in the second embodiment, and will not be described herein again.

At the stage t2, Reset=1, E1=1, E3=0, EM1=0 and EM2=0.

The working process at the stage may be substantially the same as the working process at the stage t2 in the second embodiment, and will not be described herein again.

At the stage t3, Reset=0, E1=0, E3=1, EM1=1 and EM2=1.

The working process at the stage may be substantially the same as the working process at the stage t2 in the second embodiment, and will not be described herein again.

Figure 7:
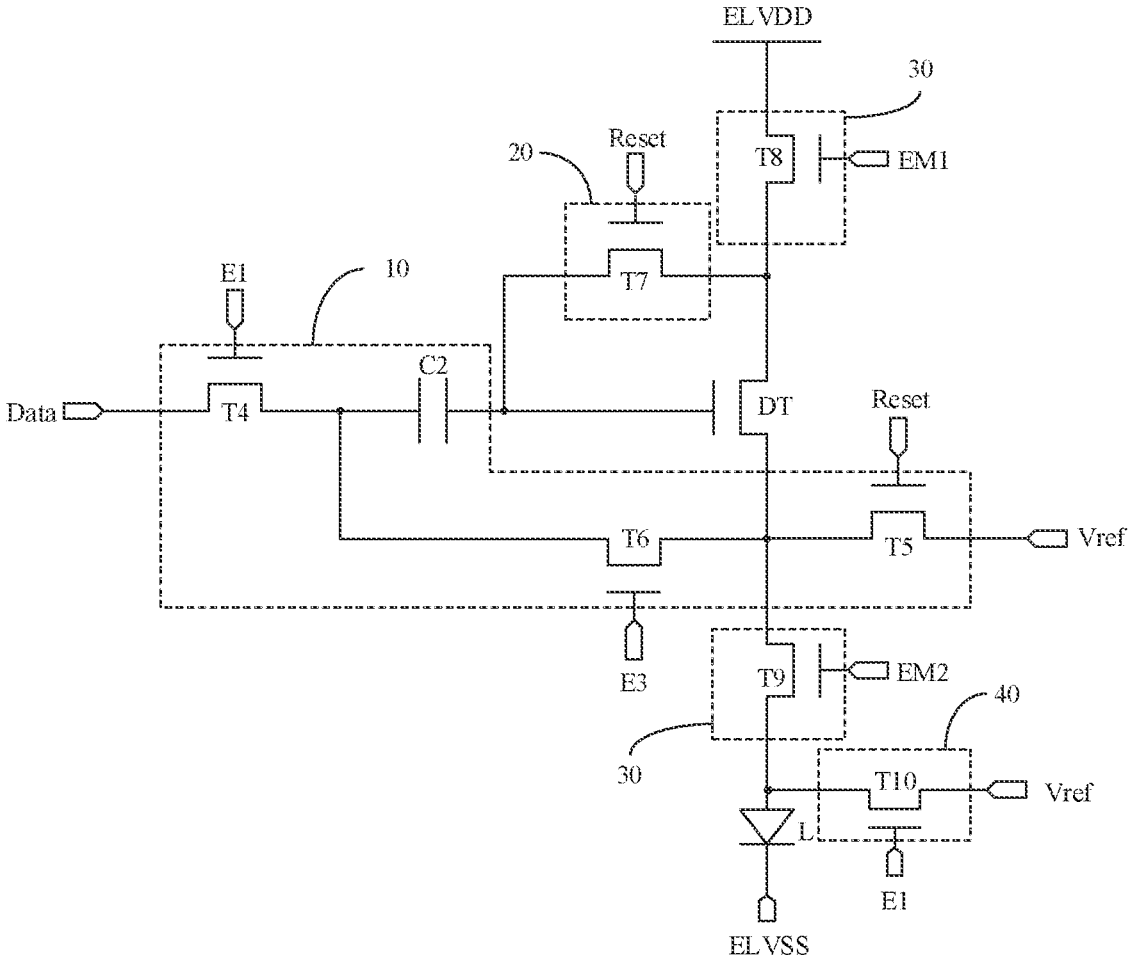
FIG. 7 is further another exemplary circuit structure diagram of the pixel circuit according to an embodiment of the present disclosure.

The pixel circuit shown in FIG. 7 is taken as an example, and the working process of the above-mentioned pixel circuit provided by some embodiments of the present disclosure is described in combination with a circuit signal timing diagram 13. Only the differences of the present embodiment and the above-mentioned embodiments will be described below, and the same parts will not be described herein again.

As shown in FIG. 7, the reset signal end Reset and the second control signal end E2 may be the same end.

Figure 13:
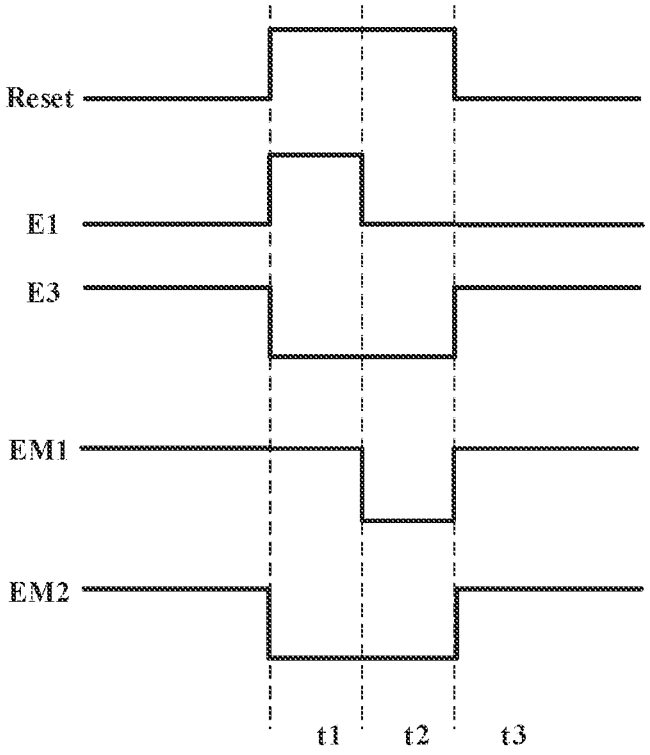
FIG. 13 is a signal timing diagram of the pixel circuit shown in FIG. 7.

Three stages t1, t2 and t3 in an input timing diagram as shown in FIG. 13 are taken as an example.

At the stage t1, Reset=1, E1=1, E3=0, EM1=1 and EM2=0.

The fourth switching transistor T4 is switched on due to E1=1, and therefore, the voltage Vdata of the data signal end Data is output to the first electrode of the second capacitor C2 through the fourth switching transistor T4. The rest of the working process at the stage may be substantially the same as the working process of the exemplary pixel circuit as shown in FIG. 4 at the stage t1, and will not be described herein again.

At the stage t2, Reset=1, E1=0, E3=0, EM1=0 and EM2=0.

The fourth switching transistor T4 is switched off due to E1=0, and the rest of the working process at the stage may be substantially the same as the working process of the exemplary pixel circuit as shown in FIG. 4 at the stage t2, and will not be described herein again.

At the stage t3, Reset=0, E1=0, E3=1, EM1=1 and EM2=1.

The working process at the stage may be substantially the same as the working process of the exemplary pixel circuit as shown in FIG. 4 at the stage t3, and will not be described herein again.

The pixel circuit shown in FIG. 8 is taken as an example, and a working process of the above-mentioned pixel circuit provided by some embodiments of the present disclosure is described in combination with a circuit signal timing diagram 14. Only the differences of the present embodiment and the above-mentioned embodiments will be described below, and the same parts will not be described herein again.

As shown in FIG. 8, the reset signal end Reset and the first control signal end E1 may be the same end.

Figure 14:
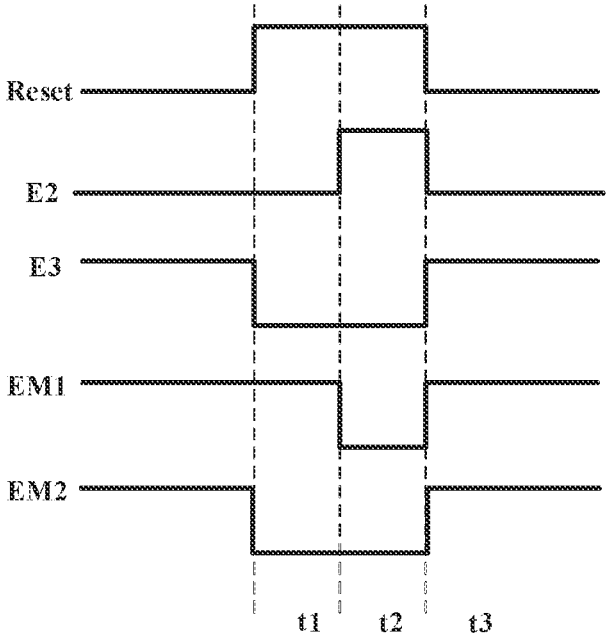
FIG. 14 is a signal timing diagram of the pixel circuit shown in FIG. 8.

Three stages t1, t2 and t3 in an input timing diagram as shown in FIG. 14 are selected as an example.

At the stage t1, Reset=1, E2=0, E3=0, EM1=1 and EM2=0.

The second switching transistor T2 is switched off due to E2=0, the tenth switching transistor T10 is switched on due to Reset=1, and therefore, the voltage VREF of the reference signal end Vref is output to the first electrode of the light emitting device L through the tenth transistor T10 to reset the light emitting device L; and the light emitting device L does not emit light due to the fact that the voltage VREF is smaller than the light emitting voltage of the light emitting device L. The rest of the working process at the stage may be substantially the same as the working process at the stage t1 in the first embodiment, and will not be described herein again.

At the stage t2, Reset=1, E2=1, E3=0, EM1=0 and EM2=0.

The tenth switching transistor T10 is switched on due to Reset=1, and therefore, the voltage VREF of the reference signal end Vref is output to the first electrode of the light emitting device L through the tenth transistor T10; and the light emitting device L does not emit light due to the fact that the voltage VREF is smaller than the light emitting voltage of the light emitting device L. The rest of the working process at the stage may be substantially the same as the working process at the stage t2 in the first embodiment, and will not be described herein again.

At the stage t3, Reset=0, E1=0, E3=1, EM1=1 and EM2=1.

The tenth switching transistor T10 is switched off due to Reset=0, and the rest of the working process at the stage may be substantially the same as the working process at the stage t3 in the first embodiment, and will not be described herein again.

Figure 15:
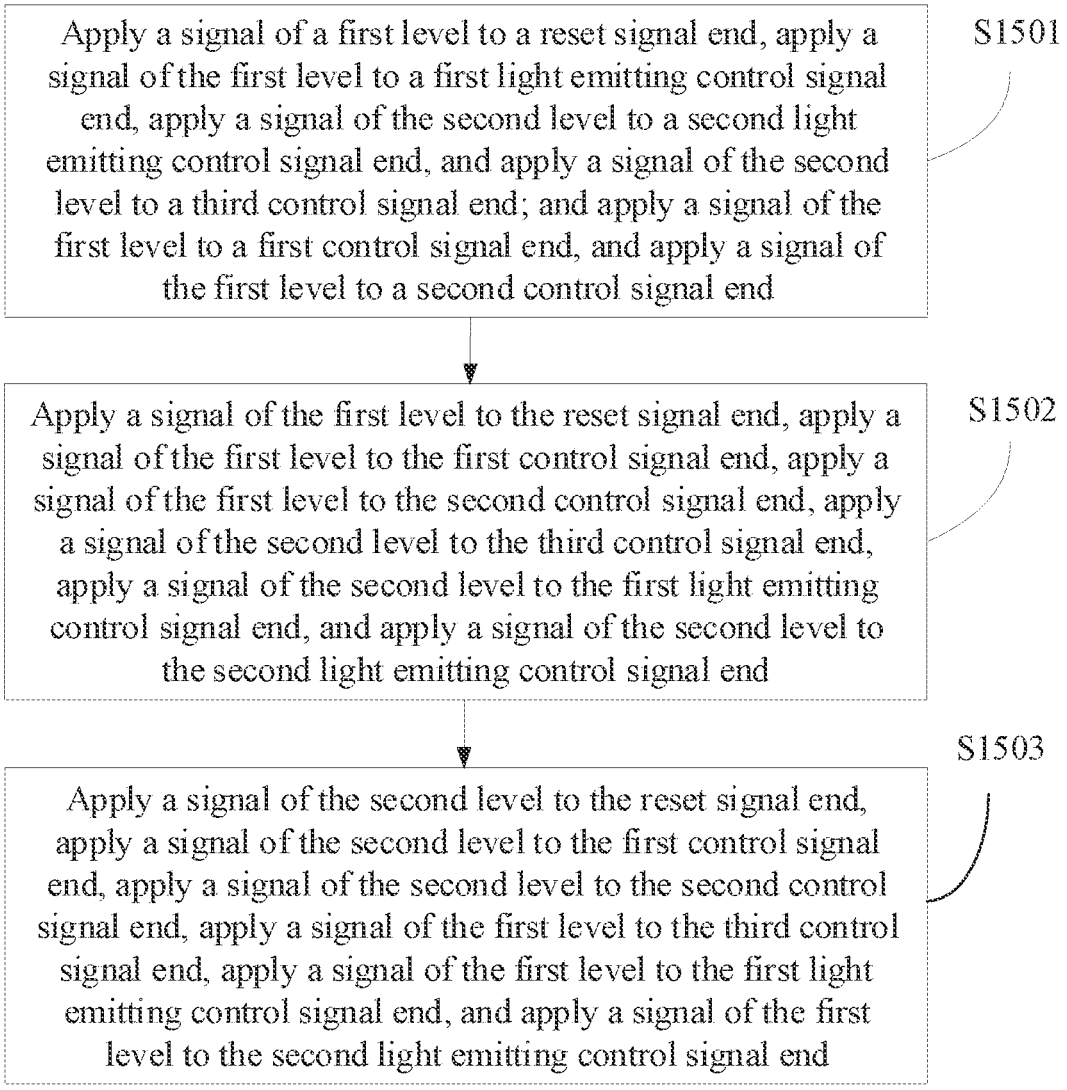
FIG. 15 is an exemplary flowchart of a driving method provided by an embodiment of the present disclosure.

An embodiment of the present disclosure further provides an exemplary driving method of the above-mentioned pixel circuit provided by some embodiments of the present disclosure, and as shown in FIG. 15, the driving method may include the following steps.

S1501, at a reset stage, a signal of a first level is applied to the reset signal end, a signal of the first level is applied to the first light emitting control signal end, a signal of a second level is applied to the second light emitting control signal end, and a signal of the second level is applied to the third control signal end; and a signal of the first level is applied to the first control signal end, and a signal of the first level is applied to the second control signal end.

S1502, at a threshold writing stage, a signal of the first level is applied to the reset signal end, a signal of the first level is applied to the first control signal end, a signal of the first level is applied to the second control signal end, a signal of the second level is applied to the third control signal end, a signal of the second level is applied to the first light emitting control signal end, and a signal of the second level is applied to the second light emitting control signal end.

S1503, at a light emitting stage, a signal of the second level is applied to the reset signal end, a signal of the second level is applied to the first control signal end, a signal of the second level is applied to the second control signal end, a signal of the first level is applied to the third control signal end, a signal of the first level is applied to the first light emitting control signal end, and a signal of the first level is applied to the second light emitting control signal end.

Figure 16:
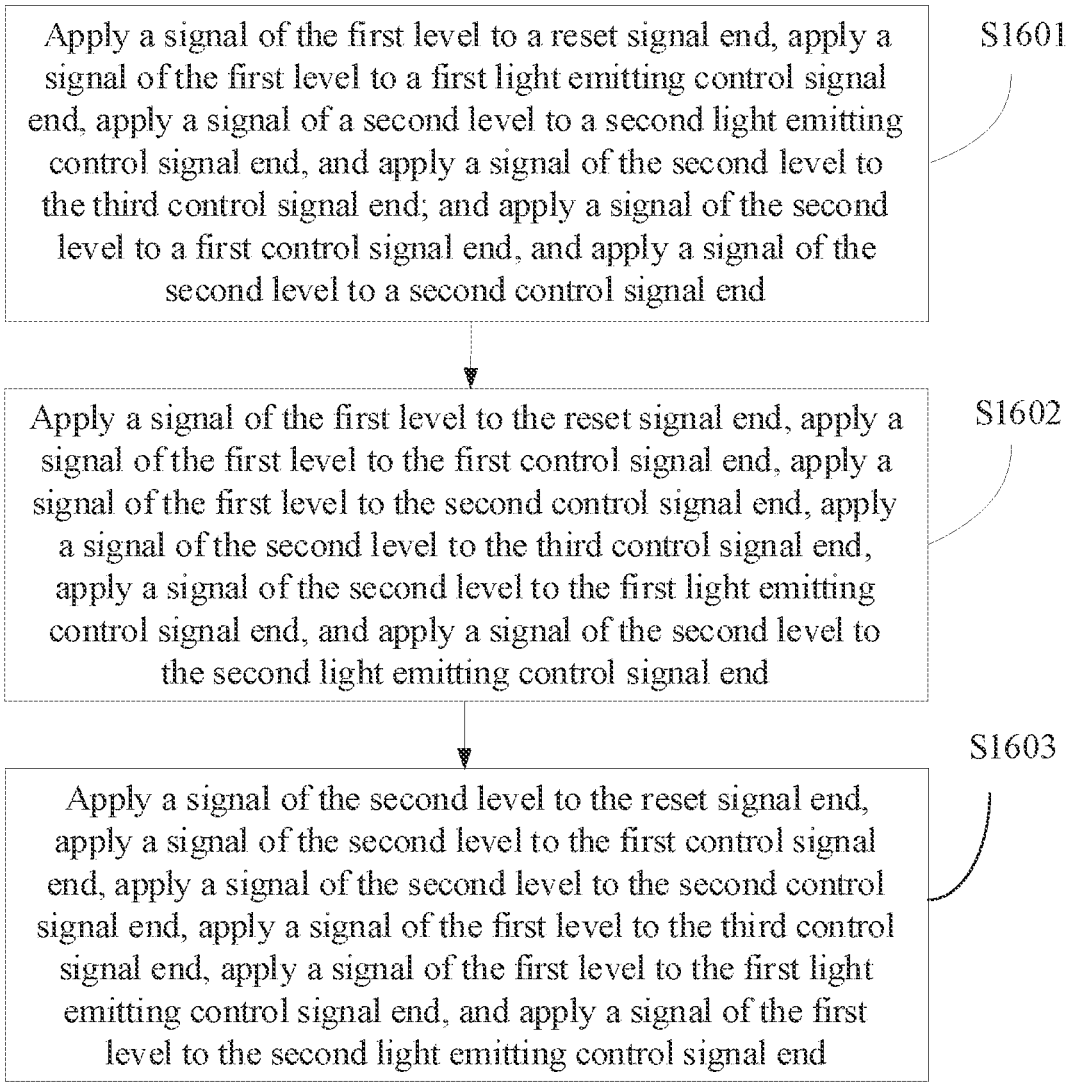
FIG. 16 is an exemplary flowchart of another driving method provided by an embodiment of the present disclosure.

An embodiment of the present disclosure further provides another exemplary driving method of the above-mentioned pixel circuit according to some embodiments of the present disclosure. As shown in FIG. 16, the exemplary driving method may include the following steps.

S1601, at a reset stage, a signal of a first level is applied to the reset signal end, a signal of the first level is applied to the first light emitting control signal end, a signal of a second level is applied to the second light emitting control signal end, and a signal of the second level is applied to the third control signal end; and a signal of the second level is applied to the first control signal end, and a signal of the second level is applied to the second control signal end.

S1602, at a threshold writing stage, a signal of the first level is applied to the reset signal end, a signal of the first level is applied to the first control signal end, a signal of the first level is applied to the second control signal end, a signal of the second level is applied to the third control signal end, a signal of the second level is applied to the first light emitting control signal end, and a signal of the second level is applied to the second light emitting control signal end.

S1603, at a light emitting stage, a signal of the second level is applied to the reset signal end, a signal of the second level is applied to the first control signal end, a signal of the second level is applied to the second control signal end, a signal of the first level is applied to the third control signal end, a signal of the first level is applied to the first light emitting control signal end, and a signal of the first level is applied to the second light emitting control signal end.

According to the above-mentioned driving method provided by some embodiments of the present disclosure, compensation on the threshold voltage of the driving transistors and IR-Drop of the first power end can be realized through simple timing sequences.

For example, the first level may be a high level, and the second level may be a low level. Or the first level is a low level, and the second level is a high level.

Based on the same concept of the disclosed embodiment, an embodiment further provides a display device. The implementation of the display device may refer to the embodiments of the above-mentioned pixel circuit, and repeated descriptions are omitted.

In specific implementation, the display device may be: any product or component with a display function, such as a mobile phone, a tablet computer, a television, a display, a notebook computer, a digital photo frame and a navigator. Other essential components of the display device should be those provided to the understanding of those skilled in the art, and are not described herein, nor should they be construed as limitations on embodiments of the present disclosure.

According to the pixel circuit, the driving method thereof and the display device provided by the embodiments of the present disclosure, the signal input sub-circuit may write the voltage of the data signal end, the voltage of the reference voltage signal end and the threshold voltage of the driving transistor into the gate electrode of the driving transistor according to the signal of the first control signal end, the signal of the second control signal end and the signal of the third control signal end. The threshold compensation sub-circuit may enable the gate electrode of the driving transistor to be connected with the drain electrode of the driving transistor under the control of the signal of the reset signal end. The light emitting control sub-circuit may provide the signal of the first power end to the drain electrode of the driving transistor under the control of the first light emitting control signal end, and enable the first electrode of the light emitting device to be connected with the source electrode of the driving transistor under the control of the second light emitting control signal end so as to drive the light emitting device to emit light. The pixel circuit provided by the embodiment of the present disclosure can compensate the threshold voltage of the driving transistor through mutual cooperation of the above-mentioned sub-circuits and the elements, so that the driving current for driving the light emitting device L to emit light is irrelevant to the threshold voltage of the driving sub-circuit, and the problem of uneven light emitting brightness caused by uneven threshold voltage is solved. Besides, through mutual cooperation of the above-mentioned sub-circuits and the elements, the voltage of the first power end ELVDD may be compensated, so that the driving current is irrelevant to the voltage of the first power end ELVDD, and the problem of uneven light emitting brightness caused by IR Drop of the first power end ELVDD may be solved.

Obviously, those skilled in the art can make various modifications and variations to the embodiments of the present disclosure without departing from the spirit and scope of the embodiments of the present disclosure. Thus, provided that such modifications and variations of the embodiments of the present disclosure fall within the scope of the claims of the embodiments of the present disclosure and their equivalents, the embodiments of the present disclosure are intended to include such modifications and variations as well.

What is claimed is:

1. A pixel circuit, comprising:

a signal input sub-circuit, configured to write a voltage of a data signal end, a voltage of a reference voltage signal end and a threshold voltage of a driving transistor into a gate electrode of a driving transistor according to a signal of a first control signal end, a signal of a second control signal end and a signal of a third control signal end;

a threshold compensation sub-circuit, configured to enable the gate electrode of the driving transistor to be connected with a first electrode of the driving transistor under the control of a signal of a reset signal end; and a light emitting control sub-circuit, configured to provide a signal of a first power end to the first electrode of the driving transistor under the control of a signal of a first light emitting control signal end; and enable a first electrode of a light emitting device to be connected with the second electrode of the driving transistor under the control of a signal of a second light emitting control signal end to drive the light emitting device to emit light wherein the third control signal end and the second light emitting control signal end are a same signal end.

2. The pixel circuit according to claim 1, wherein the signal input sub-circuit comprises: a first switching transistor, a second switching transistor, a third switching transistor and a first capacitor; wherein a gate electrode of the first switching transistor is electrically connected with the first control signal end, a first electrode of the first switching transistor is electrically connected with the reference voltage signal end, and a second electrode of the first switching transistor is electrically connected with a first electrode of the first capacitor;

a gate electrode of the second switching transistor is electrically connected with the second control signal end, a first electrode of the second switching transistor is electrically connected with the second electrode of the driving transistor, and a second electrode of the second switching transistor is electrically connected with the data signal end;

a gate electrode of the third switching transistor is electrically connected with the third control signal end, a first electrode of the third switching transistor is electrically connected with the first electrode of the first capacitor, and a second electrode of the third switching transistor is electrically connected with the second electrode of the driving transistor; and a second electrode of the first capacitor is electrically connected with the gate electrode of the driving transistor.

3. The pixel circuit according to claim 1, wherein the signal input sub-circuit comprises: a fourth switching transistor, a fifth switching transistor, a sixth switching transistor and a second capacitor; wherein a gate electrode of the fourth switching transistor is electrically connected with the first control signal end, a first electrode of the fourth switching transistor is electrically connected with the data signal end, and a second electrode of the fourth switching transistor is electrically connected with a first electrode of the sixth switching transistor;

a gate electrode of the fifth switching transistor is electrically connected with the second control signal end, a first electrode of the fifth switching transistor is electrically connected with the second electrode of the driving transistor, and a second electrode of the fifth switching transistor is electrically connected with the reference voltage signal end; and a gate electrode of the sixth switching transistor is electrically connected with the third control signal end, a first electrode of the sixth switching transistor is electrically connected with the first electrode of the second capacitor, and a second electrode of the sixth switching transistor is electrically connected with the second electrode of the driving transistor.

4. The pixel circuit according to claim 1, wherein the threshold compensation sub-circuit comprises a seventh switching transistor, wherein a gate electrode of the seventh switching transistor is electrically connected with the reset signal end, a first electrode of the seventh switching transistor is electrically connected with the gate electrode of the driving transistor, and a second electrode of the seventh switching transistor is electrically connected with the first electrode of the driving transistor.

5. The pixel circuit according to claim 4, wherein the light emitting control sub-circuit comprises an eighth switching transistor and a ninth switching transistor;

a gate electrode of the eighth switching transistor is electrically connected with the first light emitting control signal end, a first electrode of the eighth switching transistor is electrically connected with the first power end, and a second electrode of the eighth switching transistor is electrically connected with the first electrode of the driving transistor; and a gate electrode of the ninth switching transistor is electrically connected with the second light emitting control signal end, a first electrode of the ninth switching transistor is electrically connected with the second electrode of the driving transistor, and a second electrode of the ninth switching transistor is electrically connected with the first electrode of the light emitting device.

6. The pixel circuit according to claim 5, further comprising: an anode reset sub-circuit; wherein the anode reset sub-circuit is configured to enable the first electrode of the light emitting device to be connected with the reference voltage signal end under the control of a signal of the first control signal end.

7. The pixel circuit according to claim 6, wherein the anode reset sub-circuit comprises: a tenth switching transistor; and a gate electrode of the tenth switching transistor is electrically connected with the first control signal end, a first electrode of the tenth switching transistor is electrically connected with the first electrode of the light emitting device, and a second electrode of the tenth light emitting transistor is electrically connected with the reference voltage signal end.

8. The pixel circuit according to claim 1, wherein the first control signal end and/or the second control signal end, and the reset signal end are the same signal end.

9. The pixel circuit according to claim 1, wherein the first control signal end and the second control signal end are the same signal end.

10. The pixel circuit according to claim 9, wherein the third control signal end and the second light emitting control signal end are the same signal end.

11. A display device, comprising the pixel circuit according to claim 1.

12. The display device according to claim 11, wherein the signal input sub-circuit comprises: a first switching transistor, a second switching transistor, a third switching transistor and a first capacitor; wherein a gate electrode of the first switching transistor is electrically connected with the first control signal end, a first electrode of the first switching transistor is electrically connected with the reference voltage signal end, and a second electrode of the first switching transistor is electrically connected with a first electrode of the first capacitor;

a gate electrode of the second switching transistor is electrically connected with the second control signal end, a first electrode of the second switching transistor is electrically connected with the second electrode of the driving transistor, and a second electrode of the second switching transistor is electrically connected with the data signal end;

a gate electrode of the third switching transistor is electrically connected with the third control signal end, a first electrode of the third switching transistor is electrically connected with the first electrode of the first capacitor, and a second electrode of the third switching transistor is electrically connected with the second electrode of the driving transistor; and a second electrode of the first capacitor is electrically connected with the gate electrode of the driving transistor.

13. The display device according to claim 11, wherein the signal input sub-circuit comprises: a fourth switching transistor, a fifth switching transistor, a sixth switching transistor and a second capacitor; wherein a gate electrode of the fourth switching transistor is electrically connected with the first control signal end, a first electrode of the fourth switching transistor is electrically connected with the data signal end, and a second electrode of the fourth switching transistor is electrically connected with a first electrode of the sixth switching transistor;

a gate electrode of the fifth switching transistor is electrically connected with the second control signal end, a first electrode of the fifth switching transistor is electrically connected with the second electrode of the driving transistor, and a second electrode of the fifth switching transistor is electrically connected with the reference voltage signal end; and a gate electrode of the sixth switching transistor is electrically connected with the third control signal end, a first electrode of the sixth switching transistor is electrically connected with the first electrode of the second capacitor, and a second electrode of the sixth switching transistor is electrically connected with the second electrode of the driving transistor.

14. The display device according to claim 11, wherein the threshold compensation sub-circuit comprises a seventh switching transistor, wherein a gate electrode of the seventh switching transistor is electrically connected with the reset signal end, a first electrode of the seventh switching transistor is electrically connected with the gate electrode of the driving transistor, and a second electrode of the seventh switching transistor is electrically connected with the first electrode of the driving transistor.

15. The display device according to claim 14, wherein the light emitting control sub-circuit comprises an eighth switching transistor and a ninth switching transistor;

a gate electrode of the eighth switching transistor is electrically connected with the first light emitting control signal end, a first electrode of the eighth switching transistor is electrically connected with the first power end, and a second electrode of the eighth switching transistor is electrically connected with the first electrode of the driving transistor; and a gate electrode of the ninth switching transistor is electrically connected with the second light emitting control signal end, a first electrode of the ninth switching transistor is electrically connected with the second electrode of the driving transistor, and a second electrode of the ninth switching transistor is electrically connected with the first electrode of the light emitting device.

16. The display device according to claim 15, wherein the pixel circuit further comprises: an anode reset sub-circuit; wherein the anode reset sub-circuit is configured to enable the first electrode of the light emitting device to be connected with the reference voltage signal end under the control of a signal of the first control signal end.

17. A driving method of the pixel circuit according to claim 1, comprising:

at a reset stage, applying a signal of a first level to the reset signal end, applying a signal of the first level to the first light emitting control signal end, applying a signal of a second level to the second light emitting control signal end, and applying a signal of the second level to the third control signal end;

at a data input stage, applying a signal of the first level to the reset signal end, applying a signal of the first level to the first control signal end, applying a signal of the first level to the second control signal end, applying a signal of the second level to the third control signal end, applying a signal of the second level to the first light emitting control signal end, and applying a signal of the second level to the second light emitting control signal end; and at a light emitting stage, applying a signal of the second level to the reset signal end, applying a signal of the second level to the first control signal end, applying a signal of the second level to the second control signal end, applying a signal of the first level to the third control signal end, applying a signal of the first level to the first light emitting control signal end, and applying a signal of the first level to the second light emitting control signal end.

18. The driving method according to claim 17, further comprising: at the reset stage, applying a signal of the first level to the first control signal end, and applying a signal of the first level to the second control signal end.

19. The driving method according to claim 17, further comprising: at the reset stage, applying a signal of the second level to the first control single end, and applying a signal of the second level to the second control signal end.

* * * * *